United States Patent [19]

Hall

[11] Patent Number: 4,989,863

[45] Date of Patent: Feb. 5, 1991

[54] GAMES TABLE

[76] Inventor: David A. Hall, Greenborough House Twinney, Upchurch Sittingbourne, Kent, England, ME9 7DA

[21] Appl. No.: 284,365

[22] Filed: Dec. 14, 1988

Related U.S. Application Data

[63] Continuation of Ser. No. 929,854, filed as PCT GB86/00115 on Mar. 4, 1986, published as WO86/05110 on Sep. 12, 1986, abandoned.

[30] Foreign Application Priority Data

Mar. 7, 1985 [GB] United Kingdom ..... 8505959
Apr. 2, 1985 [GB] United Kingdom ..... 8508577
May 9, 1985 [GB] United Kingdom ..... 8511805

[51] Int. Cl.[5] ..... A63D 15/00
[52] U.S. Cl. ..... 273/3 A; 273/3 C
[58] Field of Search ..... 273/2, 3 A, 3 R, 4 R, 273/4 B, 4 C, 6, 7, 8, 9, 13, 22; 272/3

[56] References Cited

U.S. PATENT DOCUMENTS

| | | | |
|---|---|---|---|
| 43,829 | 8/1864 | Bradley | 273/3 C |
| 1,150,517 | 8/1915 | Hawks | 273/9 |
| 1,266,125 | 5/1918 | Johnson et al. | 273/8 |
| 1,269,614 | 6/1918 | Lapp | 273/3 R |
| 1,933,917 | 11/1933 | Matteson . | |
| 1,946,232 | 2/1934 | Olson et al. | 273/3 R |
| 2,243,943 | 6/1941 | Bunting | 272/3 |
| 2,809,040 | 10/1957 | Trovato | 273/9 |
| 3,319,958 | 5/1967 | Bender | 273/9 |
| 3,323,797 | 6/1967 | Horton, Jr. | 273/3 R |
| 3,458,193 | 7/1969 | Rockwood . | |
| 3,489,410 | 1/1970 | Stillman, Jr. et al. | 273/9 |
| 3,876,202 | 4/1975 | Allison | 273/3 C |
| 3,889,945 | 6/1975 | Ellis | 273/8 |
| 3,993,412 | 11/1976 | Drane | 272/3 |

FOREIGN PATENT DOCUMENTS

| | | | |
|---|---|---|---|
| 485637 | 9/1976 | Australia . | |
| 592650 | 2/1934 | Fed. Rep. of Germany . | |
| 631100 | 12/1927 | France . | |
| 3806 | 3/1885 | United Kingdom | 273/3 R |

*Primary Examiner*—Theatrice Brown
*Attorney, Agent, or Firm*—Nixon & Vanderhye

[57] ABSTRACT

A ball games table comprises a table top demountably fixed to a table base, the top being boarding with sheeting forming a playing surface stretched over its upper surface: one of the boarding and sheeting being water impervious. The sheeting may comprise a plurality of sheets each covering the boarding, at least one of which is water impervious; the boarding itself may be water impervious. The use of rubber sheeting is described as is canvas or tarpaulin sheets with one or more plastics sheets positioned between the sheet and the boarding. The boarding may be a number of separate parts, held together by the sheeting (and optionally hinged together), and rigidly interconnected as the table is assembled. The abutting edges of the parts of the top may extend in different directions and be non-linear; following meandering, wavey or zig-zag paths, when the table is assembled. To level the playing surface the table legs are adjustable in length and the top is, in one embodiment, supported on the table base with the interposition of a plurality of members the heights of which may be individually varied.

6 Claims, 7 Drawing Sheets

GAMES TABLE

Figure 1:
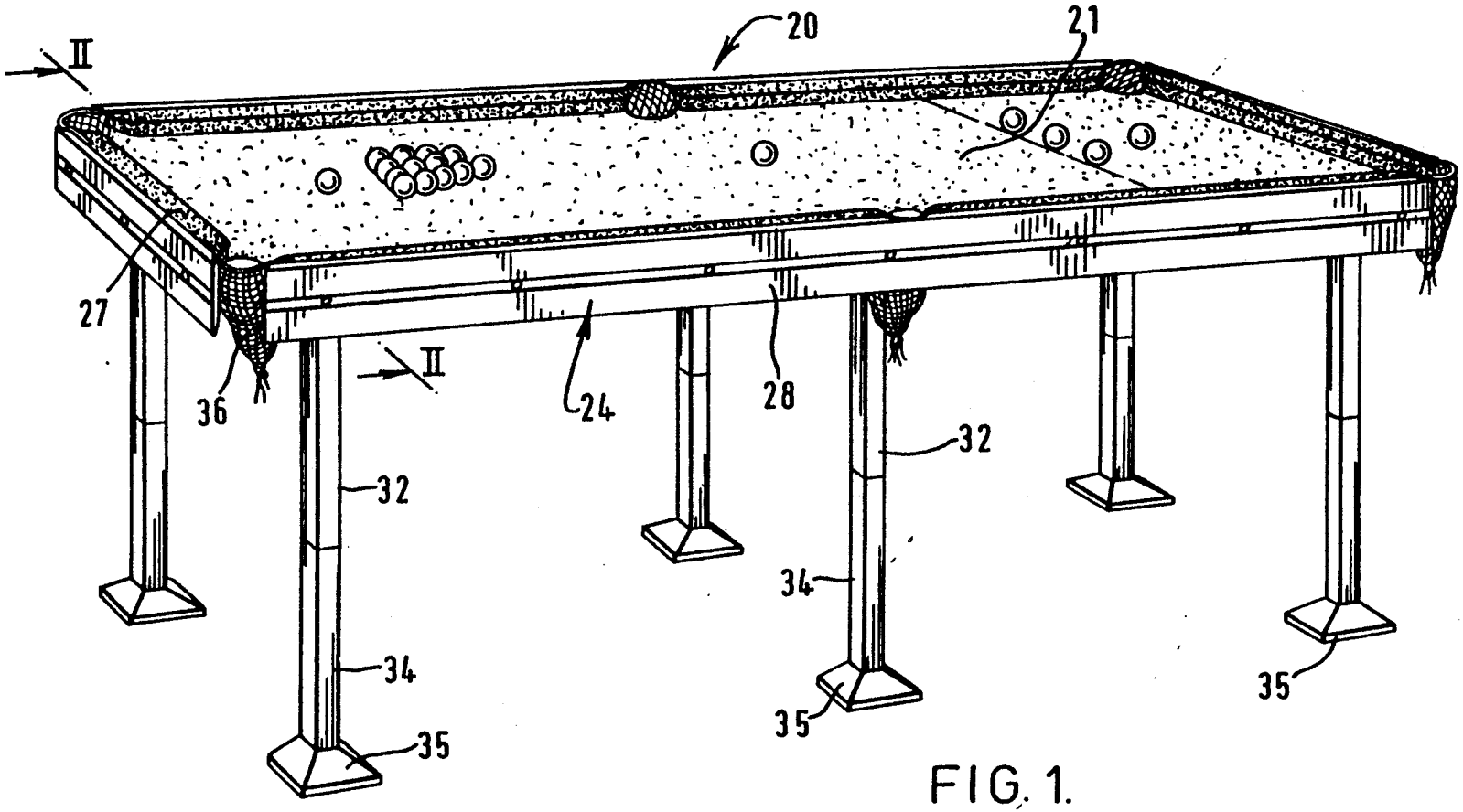

This application is a continuation of application Ser. No. 06/929,854, Oct. 27, 1986 (now abandoned).

The invention concerns games tables, particularly tables for playing ball games such as Snooker, Billiards and Pool.

Such ball games, or games essentially similar to them, have been played for a considerable time throughout the world, and the same type of table is used for each of variant of the game e.g. Snooker, Billiards, Pool, Russian Billiards, American Pool etc..

Traditionally, the tables used for these games have a hard wood frame (for example Mahogany) supporting a slate bed upon which a felt playing surface is provided. Such a construction, particularly with a full sized table (for example a Snooker table measuring 12'×6'-3.7 m ×1.85 m) is extremely expensive and weighty. Often there is need to reinforce the floor on which such a table stands.

Another difficulty found with these tables in modern houses is that there is often insufficient room in which to locate the table; a full size Snooker table, for example requires a "free" playing space of at least 23'×17'-7.1 m ×5.25 m.

A solution to this problem would be to locate the table outdoors: however; the traditional table construction (felt-on-slate) does not withstand inclement weather well and soon becomes unplayable Again; the traditional, weighty, construction of the table makes it difficult for it to be carried in and out of doors as required.

Alternative constructions of such tables using wood or board have been proposed and these tables are more portable than tables made traditionally However, they generally all suffer from the drawbacks that the playing characteristics differ from tables made traditionally and that the playing surface tends to become warped or bent rapidly in use or if left open to the weather.

An object of the invention is to provide a ball games table which overcomes or at least alleviates some of these problems and which has the playing characteristics of a traditionally made table.

In accordance with one aspect the invention provides a ball games table having a table top fixed to a table base, the table top comprising flat boarding having sheeting stretched thereover and affixed thereto, the upper surface of which sheeting forms a playing surface for ball games, wherein one of the boarding and sheeting is impervious to water.

Preferably the top is demountably fixed to the table base and the base is also separable into component parts.

The sheeting may with advantage comprise a plurality of separate sheets each of which is stretched over and covers the boarding, at least one of said sheets being impervious to water. The sheeting forming the playing surface may comprise one or more of sheets of natural or synthetic rubber, plastics sheeting, a knitted or woven natural or synthetic fabric naturally or treated to be water impervious, canvas or tarpaulin. The sheet of material forming the playing surface may be pimpled, roughened or textured plastics or rubber material. In one embodiment the sheet of material forming the playing surface is of canvas or tarpaulin and one or more sheets of plastics material are interposed between that sheet and the boarding. The table top is desirably supported on the table base with interposition of a plurality of members the heights of which may be individually varied to allow the table top to be levelled, and the table base with advantage has leg members the lengths of which may be adjusted such that the table and its playing surface may be levelled.

The material forming the table top may be one of plastics, wooden, fibre-, chip- or block - board or plywood or plastics material.

With particular advantage the table top comprises a plurality of sections interconnected by said sheeting; with the optional use of hinges interconnecting sections of the boarding, means being provided on the different sections enabling the rigid interconnection of the sections one with another as the table is assembled.

The abutting edges of said sections may extend in different directions and the join lines of different sections may be non-linear following meandering, wavey or zig-zag paths, when the table is assembled.

With particular advantage the base for the table comprises a light weight space frame of wood, metal or plastics materials the constituent parts of which are readily separable.

In a second aspect the invention provides a kit of parts for forming a table which, when assembled, has the features noted above.

Figure 2:
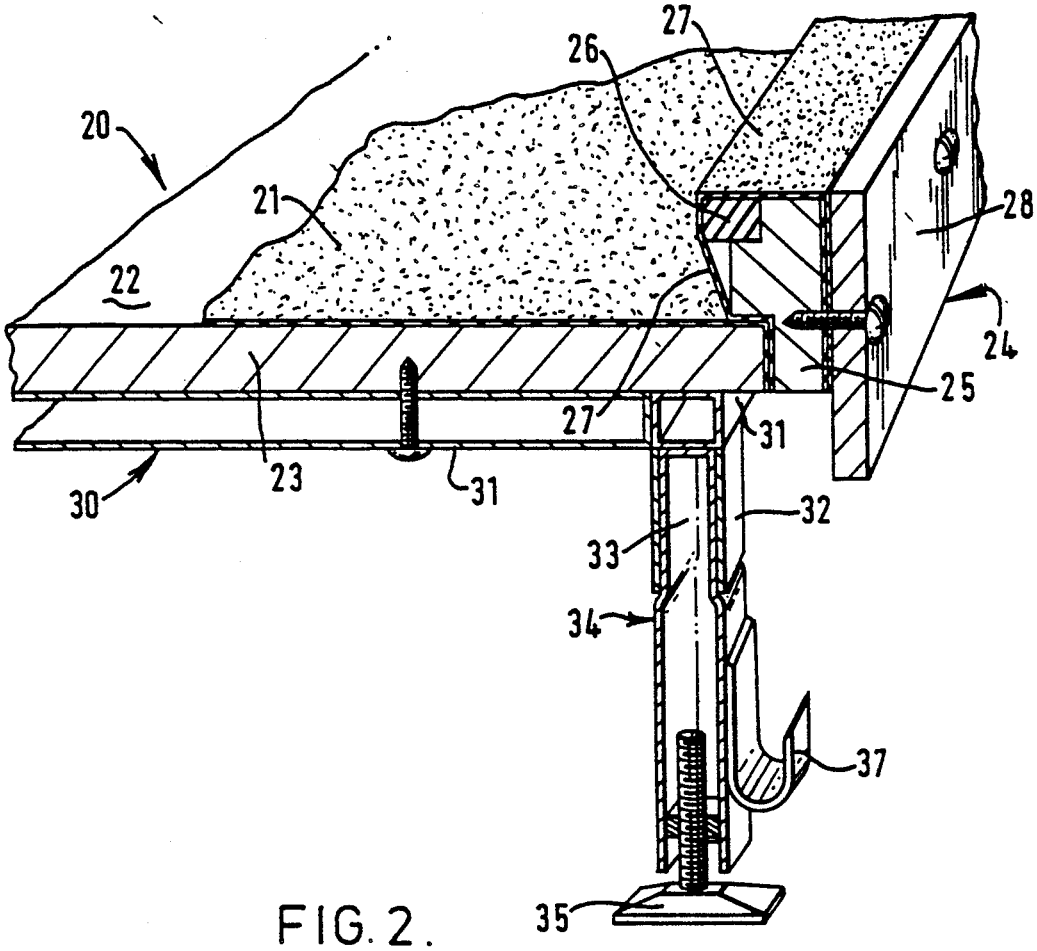
Figure 4:
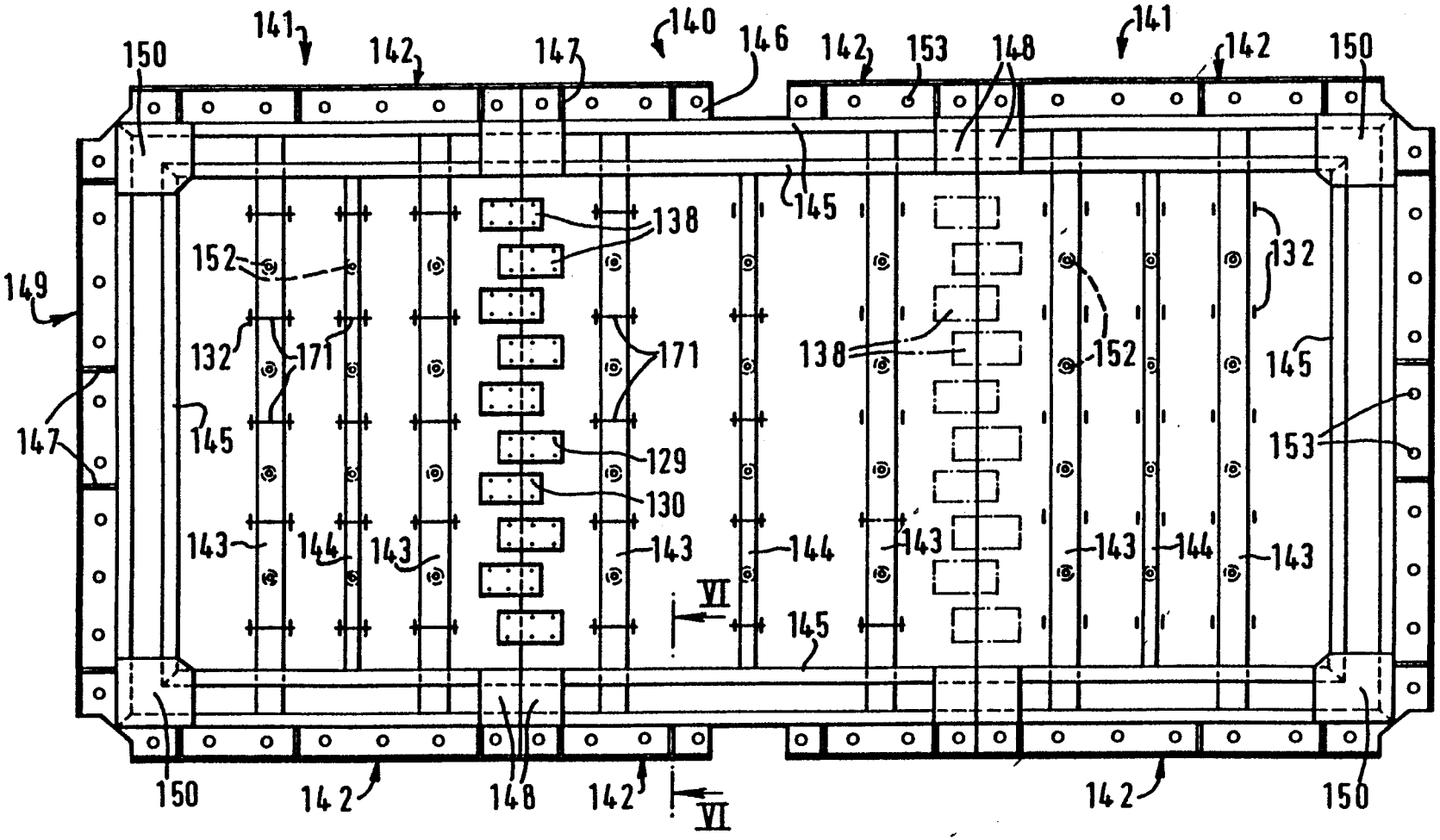
Figures 3, 5:
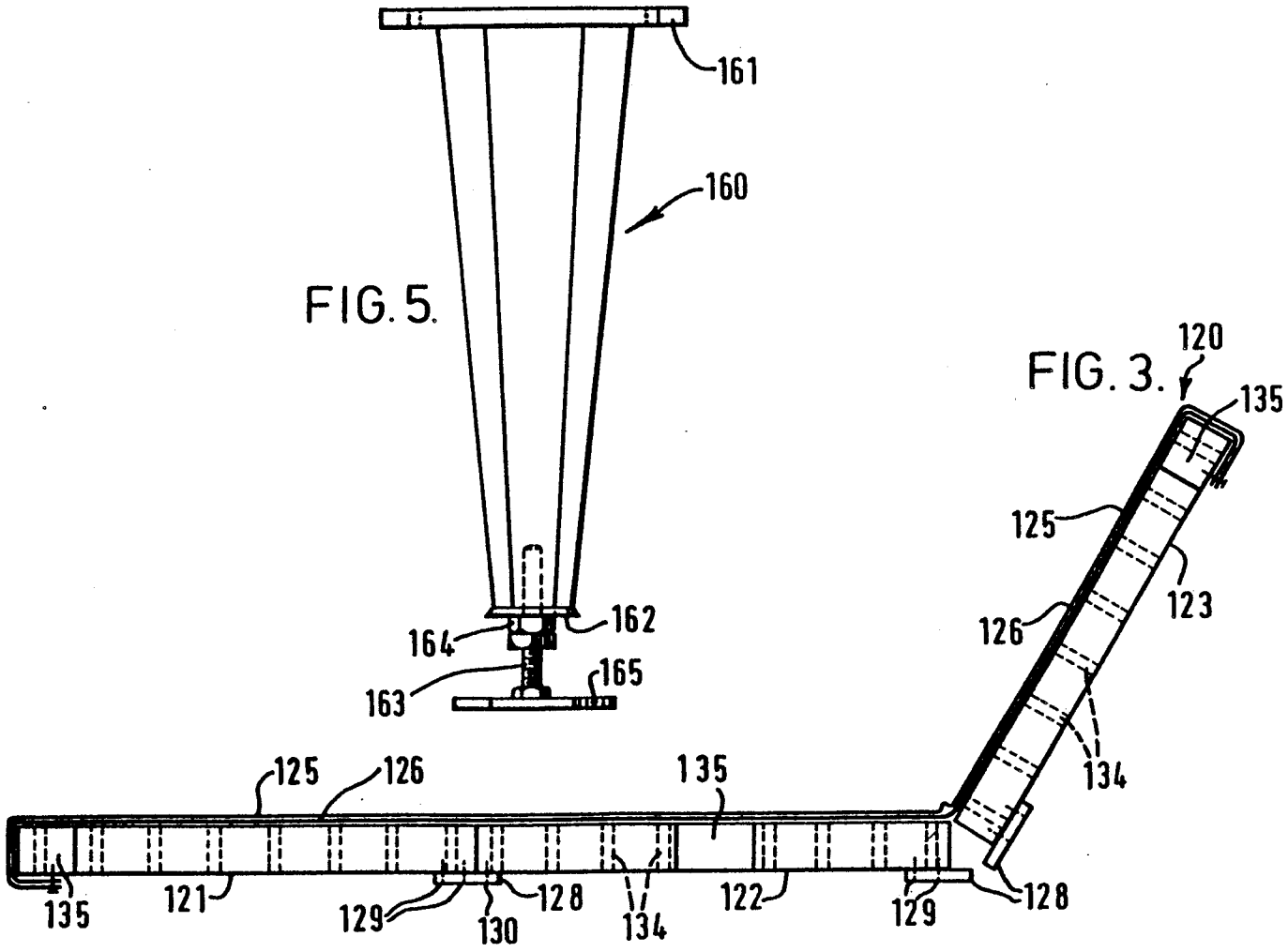
Figure 6:
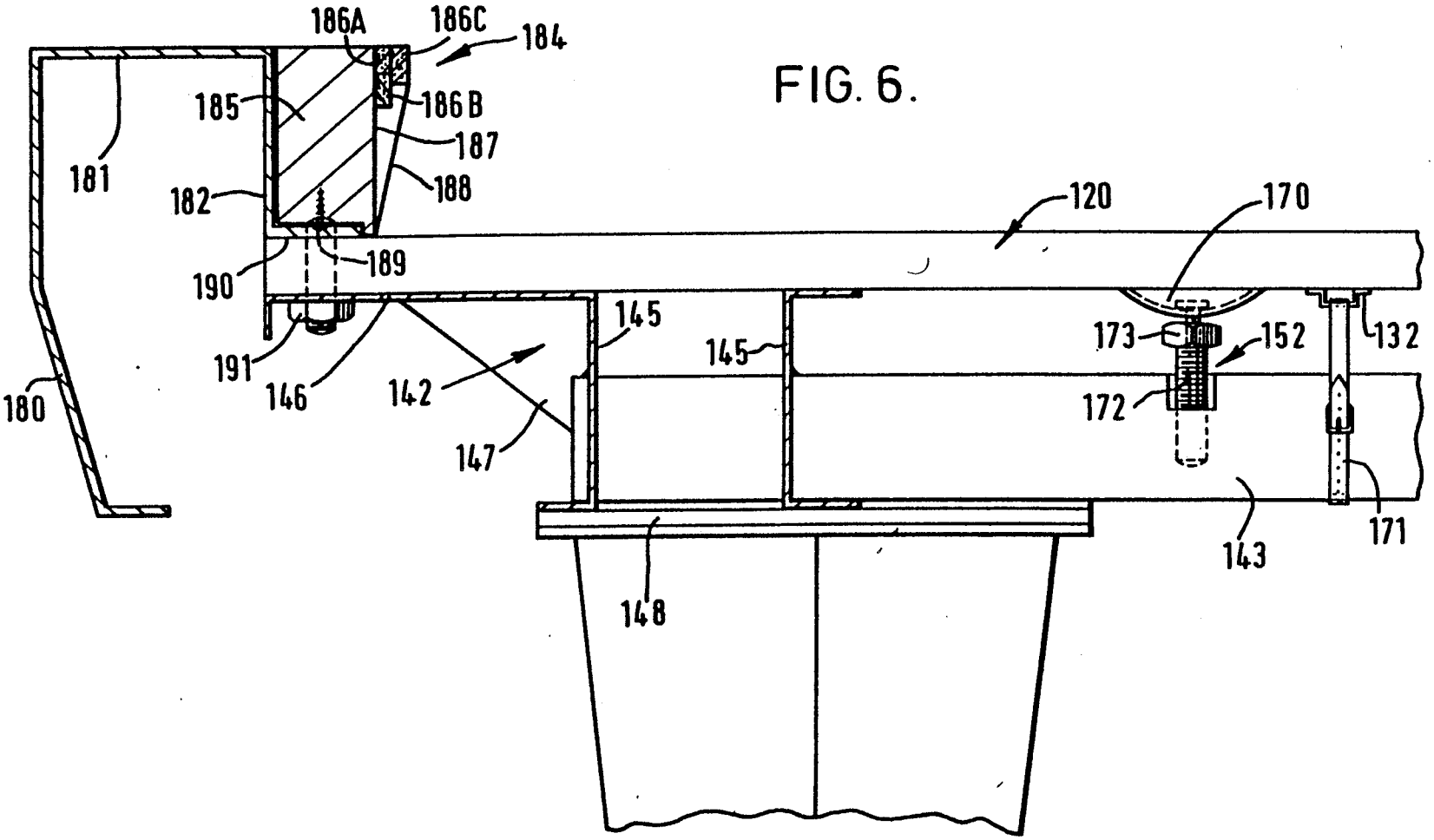
Figure 7:
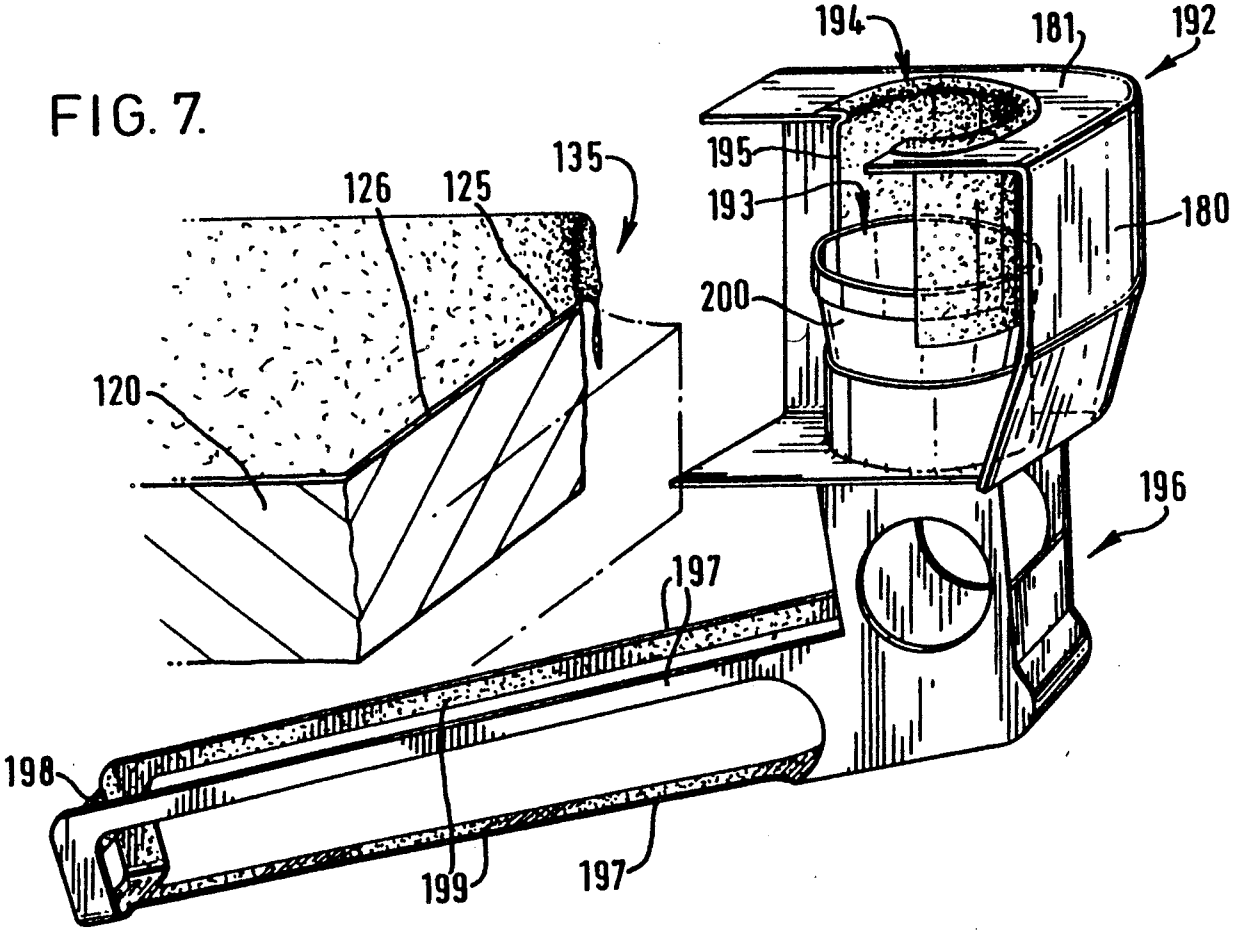
Figure 8:
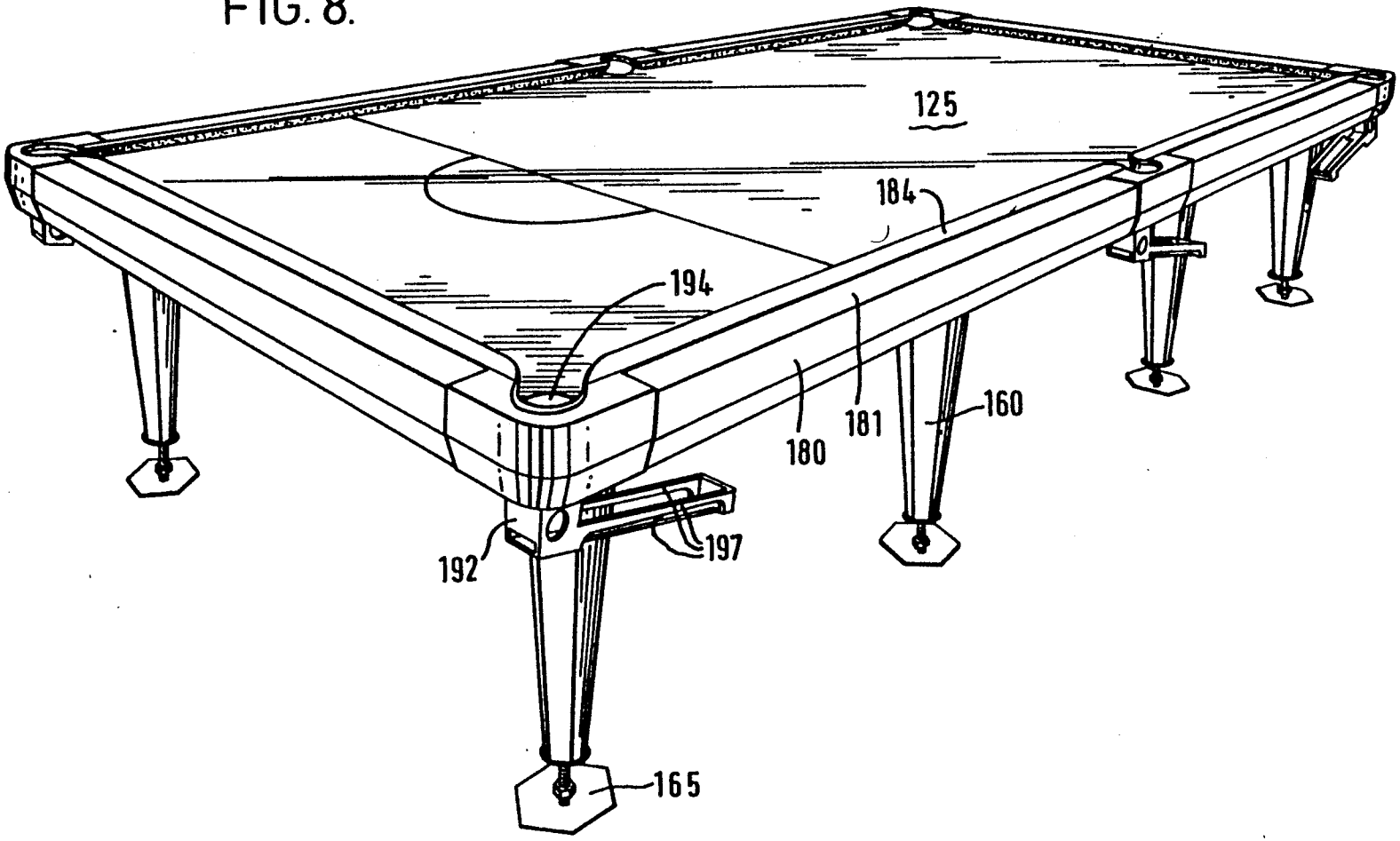

Embodiments of the invention will now be described with reference to the accompanying drawings in which:

FIG. 1, is a perspective view of a first table embodying the invention,

FIG. 2, is an enlarged sectional view taken on the line II—II of FIG. 1, FIG. 3, is a sectional view of a top for a second table embodying the invention, FIG. 4, is an underneath plan view of a base for the second table with the top fitted, FIG. 5, is a side view of a leg of the second table, FIG. 6, is a sectional view drawn on the line VI—VI of FIG. 4, FIG. 7, illustrates a corner pocket of the second table, and FIG. 8, is a perspective view of the second table when assembled.

FIGS. 1 and 2 show a first table embodying the invention to have a table top 20, the playing surface of which is formed as the upper side of a sheet 21 of pimpled rubber similar to that used on table tennis bats. Sheet 21 is stretched over a surface 22 of a board member 23 which comprises a glass or carbon fibre reinforced plastics material honeycomb between two flat sheets of similar material The edges of sheet 21 are clamped at the sides and end of member 23 by rails 24. The rails 24 comprise wooden mouldings 25 supporting resilient rubber cushions 26. The rails 24 are fixed to the member 23 by screws. Also clamped between the edge of member 23 and the rails 24 is the edge of a rubber sheet 27 (similar to sheet 21) which extends about moulding 25 and cushions 26 and has its other edge clamped between the moulding 25 and a fascia board 28 screwed or bolted onto moulding 25. The sheet 27 may be formed as part of the sheet 21, a fold in the sheet 21 being trapped beneath the rails 24 before the sheet is continued over those rails.

Member 23 rests on a table base 30 in the form of a wooden space frame formed of members 31. Members 31 are bolted together and the table top 20 is fixed to base 30 by screws, bolts clips, or in any other suitable way. The base 30 has a plurality of open ended metal members 32 which depend from it, and into the open ends of which shaped tops 33 of metal legs 34 locate The legs 34 have adjustable feet 35 enabling the height of each to be adjusted and thereby the playing surface of the table to be levelled This enables the table to stand and be played on an un-level surface, for example certain floors or on open ground outdoors.

Table pockets 36 the backs of which are coated with a water impervious material having the same characteristics as leather are provided. Brackets 37 may be provided on the legs 34 to support playing equipment (cues, rests etc.) and fascia board 28 may carry a score board (not shown) to assist score keeping whilst a game is in progress.

It will be seen that the arrangement described with reference to FIGS. 1 and 2, may be varied without departing from the scope of the invention.

In one alternative arrangement the table top may simply lie on the table base. Other forms of table base may be used providing they are suitably rigid, e.g. another table, a scaffolding arrangement or in (or on).any other suitable supporting frame.

The fixing between the table top and the base on which it stands may be as shown or varied, e g. it may comprise clamps which act on the edges of the table top overhanging the base and pre-stress the table top ensuring that it is flat and unbowed across its width.

Although described as having six it will be seen that the number of legs which are provided may vary in accordance with the need to provide adequate support for the playing surface and to a large extent will depend upon the overall size of the table.

The pockets may be of the type shown or be replaced with "drop rails" of any suitable form and material.

The rails of the table may be of the material and particular construction described or, alternatively, of other materials and construction. For example the rails may be of wood, metal or the like and the resilient inserts may be of any suitable material (e.g. foamed plastics materials, cork or other material). In some instances the rails need not be covered by the material forming the playing surface, and their fixing to the base may be varied, for example by making use of dowels, bolts or the like, in order that they are readily detachable from the table to enable their rapid removal, if necessary.

The base may be of plastics or light metal members instead of wood and the joints between members may be made by bolting , gluing, or welding as required The table top may be fixed to the base in any suitable way, for example making use of screws, bolts or clips The legs may be provided with casters enabling the ready movement of the table if required.

Another alternative to the arrangements disclosed above is that the legs used to support the the table may be provided as light-weight, hollow section metal members hinged to the table top and readily carried therewith when the table is disassembled.

The top member may be of any construction giving a flat, rigid surface on which the material forming the playing surface is positioned The material forming the playing surface may be affixed to the top member after it has been stretched over it with any suitable adhesive or in any other suitable way.

The table top may be formed of not only of the described wood and/or plastics materials, but may also be formed of other suitable materials such as lightweight, composite fibre filled board materials such as those sold under the Trade Name DUFAYLITE. Two alternatives to the described materials for the table top are block or chipboard which are both inexpensive and readily obtainable.

Materials other than natural or synthetic rubber may be used for the sheet forming the playing surface providing they give normal playing characteristics, and, if necessary (the material of the board being susceptable to water damage), are water impervious. Such other materials may include woven or knitted fabrics which are naturally or have been treated to be water impervious (chemically or by coating), canvas materials and tarpaulins as used in tenting and plastics sheeting The sheeting used may be provided with fibres affixed to one surface of thereof to give the playing characteristics of traditional 'felt-on-slate' tables.

The method of levelling the table may be as described or modified by providing that the levelling is effected by locating elements (adjustable or of selected height) upon the base frame immediately beneath the table top as it is positioned on the base.

One possible arrangement provides that retractable castor wheels are provided and that the levelling means for the table are provided as height adjusters acting directly upon the floor on which the table stands, the castor wheels being movable from a position clear of the floor to a position supporting the table when it is desired to move the table.

Some of the above noted alternatives will be described in more detail in connection with the second and preferred form of table embodying the invention shown in the remaining Figures of the drawings.

The second table to be described has the advantages of the table described above and may, in addition, be more readily disassembled, carried and stored.

It is envisaged that this second from of table may be sold in kit form and in the following description the method of erection of the table will be described It is to be noted that the table need not only be sold in kit form and the assembly steps noted below will then be carried out prior to delivery of the table to a user. In any event the particular form of construction described enables a user to readily break the table into a number of constituent parts which may be more easily stored and/or carried.

FIG. 3 shows a different form of table top 120 comprising three sections 121, 122 and 123 of equal size The Sections 121, 122 and 123 are of marine or similar grade plywood and are connected to one another by a tarpaulin 125 and another material sheet 126 which overlie the three sections. The material layers are fixed to the sections by pins, staples adhesive or in any other suitable way. It will be appreciated that FIG. 3 shows a view of the table top in a state of disassembly - not having side rails attached to it and not attached to a table base. The table top 120 shown in FIG. 3 may be folded upon itself in the following way; first, section 121 is rotated to overlie section 122, and when this has been done section 123 may be moved to a position overlying section 121. The strength of the fabric material overlying the sections 121, 122 and 123 permits this movement The tarpaulin used is of tenting grade and the other material sheet preferably comprises a sheet of flexible textured plastics material approximately 0.5 mm thick.

During assembly the different sections of the table top are rigidly fixed to one another by means of the flanged plates 128 shown thereon in the following way. Plates 128 are fixed to the sections at two opposed edges of each section 121, 122 and 123 by means of screws 129 such that as the table is assembled and the sections are unfolded the edges of them intended to abut are brought into juxtaposition, with the plates 128 of one section interleaved with those of the adjacent section. In this position the plates 128 of one section overlie the edge of the adjacent section of the table top and and as soon as the abutting edges are brought together are fixed thereto by screws 130. In this way the three sections 121, 122 and 123 form a rigid table top which may then be positioned on the base of the table.

Disassembly of the table top by a user is simply the reverse of the above process.

The table top also has a plurality of U-shaped clips 132 screwed onto that surface of it opposite the playing surface and is formed with holes 134 at its edges which pass through the board and the covering material layers. Arcuate cut-out sections 135 are provided at the corners of the top 120 and the centres of the edges of the section 122 to form holes through which balls may drop in play. The tarpaulin sheet 125 may be extended into the arcuate cut outs 135 and additional lengths of the same material affixed thereto by stitching.

In use the rigidity of the table top 120 is enhanced by its fixture to the table base (all parts of which unless otherwise noted are of rigid galvanised and painted steel) and secondly by the fixture of the side and end rails to it.

The base to which top 120 is fitted is shown in FIG. 4 to comprise three equal sections: a centre section 140 and two end sections 141. The base is symmetrical about its vertical centre line and the right side viewed in the figure is a mirror image of the left side shown in detail. Section 140 comprises two side members 142 interconnected by a pair of outer cross members 143 and a central cross member 144 as shown. Each member 142 (see FIG. 6) comprises two vertical rails 145 extending the length of the section and flanged at top and bottom. An extended flange 146 is provided on one of the rails 145 running away from the centre of the table as shown. The rigidity of flange 146 is ensured by webs 147 welded in positions shown. The outer cross members 143 are box-section lengths which pass through both rails 145 on each side of section 140 and are welded thereto. The central cross member 144 is an open box-section length welded to the inner rail 145 of section 140. The rails 145 are joined to one another at their ends by plates 148 welded onto the flanged lower (when assembled) edges of them.

Each end section 141 is generally similar to the central section and like parts are given the same reference numerals in the drawings. In addition to the side members 142 the end sections are provided with end members 149 which are substantially the same as the side members 142 save that plates 150 are welded across the corners of the end and side sections—specifically to the lower flanged edges of the rails 145 in those sections. A plurality of level adjusters 152 are provided in and extending above the the tops of the cross members 143 and 144 upon which in the assembled state the the table top 120 bears.

As can be seen the flanges 146 of the centre section 140 are cut midway along their length and the corners of the end sections 141 are left 'open' to allow for insertion of pockets for the table (to be described below). Additional holes 153 are provided in the flanges 146 through which studs pass to hold in position side and end rails for the table as it is assembled.

The plates 148 and 150 on the side and end sections 140 and 141 are predrilled to accept bolts which, when the table is assembled rigidly attach the top to the table legs.

Each leg 160, see FIG. 5, comprises a hollow six sided pyramidical steel structure to the ends of which are welded rectangular plates 161 and 162. The plate 161 welded to the larger end of each leg 160 wider than the top of the leg and those parts of it extending to the sides of the leg are pierced with holes through which bolts may be passed to enter the holes in the plates 148 and 150 described above (FIG. 4.)

The plates 162 at the narrower end of each leg 160 are pierced to receive a threaded height adjuster 163 which moves vertically therein to enable adjustment of the height of the table. A lock nut arrangement 164 allows the length of the leg to be adjusted and fixed. The lower end of the member 163 is linked to a foot plate 165 which, in use, bears on the floor or ground on which the table stands.

The table base is formed by first fixing four legs to the plates 148 of the centre section 140. The plates 161 on the tops of these legs are positioned to partially overlie the plates 148 of the centre section and bolts are passed through the holes in them and tightened. The plates 161 extend over the edge of the plates 148 and after legs have been fitted to the end sections 141 (bolted onto the plates 150) the end sections are offered up (positioned) such that the 'free' areas of the plates 148 thereon overlie the remaining portions of the plates 161 of legs on the centre section.

Once the table base has been formed in this way it is levelled by adjustment of the leg height adjusters 163. Then the heights of the bearing parts 170 of the level adjusters 152 provided on the cross members 144 and 145 are adjusted by adjusting the height of threaded bolt members 172 in the cross members 144 and 145 by means of nuts 173 to bring them to the same height across the width and length of the table base. Thereafter the assembled table top 120 is laid on the table base with its undersurface in contact with the. flanges 146 and with the bearing parts 170. By means of straps 171 which pass through pairs of the clips 132 and beneath the cross members 143 and 144 the top 120 is pulled down onto the bearing parts 170 of the level adjusters 152. The playing surface is finely levelled, if necessary, making use of a spirit level and further adjustment of the nuts 173. As soon as the correct level is achieved the straps 171 are tied into position holding the top on the base.

The side and end rails of the table ar fitted in the following way.

Each side and end rail for the table comprises a metal section of the form shown in FIG. 6, that is to say a first part 180 forming a fascia for the table, a second part 181 forming a horizontal ledge at the edge of the table and a third part 182 upon which the cushion 184 for the table is located. The cushion 184 comprises a wooden main member 185 having attached to it a resilient buffer generally as shown at 186. I have found by experimentation that the best formation for this buffer is as shown, that is to say, three rectangular section rubber pieces 186A, 186B and 186C arranged as shown. To make the cushion, firstly the piece 186A is adhesively fixed to the face of member 185 and a layers of adhesive tape 187 wrapped around the member 185 and the piece 186A to bind the piece firmly onto the member 185. Secondly, the section 186B is glued by the side of the piece 186A and further layers of adhesive tape 187 wrapped around the two pieces 186A and 186B and around the member 185. Thirdly, the piece 186C is glued in the position shown and further layers of adhesive tape applied to overlie the three pieces 186A, 186B and 186C, and the member 185. Finally, leatherette or vinyl material 188 is fixed to the undersurface of the member 185, run over the buffer 186, across the top of the member 185 and fixed to the rear surface of the member 185 as shown. The provision of the layers 187 holding the rubber pieces in position aids the playing characteristics of the table by providing that vibrations caused when a ball strikes the rail are sufficiently damped.

The cushion 184 is fixed by screws 189 passing through holes in the horizontal section 190 of the third part 182, and advantageously a layer of mastic sealant is run between the cushion and the vertical section of the part 182 as the cushion is positional thereon.

The ends of the cushions are bevelled to accommodate the table pockets in the usual way and, it will be seen from FIG. 6, member 185 is shaped so that the cushion overlies the edge of section 190 and rests directly on the playing surface of the assembled table. Indentations are provided in the undersurface of member 185 to accommodate heads of threaded studs 191 formed integrally in the section 190 which, as the table is assembled are passed through the holes 134 and 153 in the table top 120 and the flange 146. After positioning the complete rails are fixed in position by nuts as shown on the studs 191.

The corner pocket member shown in FIG. 7 comprises a part 192 shaped to continue the outer form of the rails 180 around the corners of the table and attachable to those rails by bolts passing through preformed holes formed in both pocket and rails members Parts of the corner member in essence similar to parts of the rail members already described are given the same reference numerals.

Within the upper part 181 of the corner pocket member is an aperture 193 as shown which, together with the cut out corners 135 of the table top 120 form a hole 194 into which a ball may be played Hole 194 has a back wall 195 formed as a rubber moulding fitted onto the cut edge of the the upper part 181 of the member and leading to a drop rail arrangement welded to the lower—horizontally extending part of the fascia 180 of the member 192 The drop rail arrangement comprises an open cup section 196 to carry a ball falling from the playing surface to three bars 197 forming, with an end plate 198, a container open to the top for balls played into the pocket. The metal surfaces of the cup 196, bars 197 and end plate 198 against which a ball bears as it runs into the pocket are provided with rubber buffers 199 to both protect the balls and reduce noise A rubber funnel 200 is provided within hole 194 leading from the playing surface to the drop rail arrangement, again to reduce noise and wear.

The drop rail pockets shown in FIG. 7 may be replaced by net pockets carried on metal wires screw fitted in position on the lower horizontally extending section of the fascia, such an arrangement is less expensive and enables the ready replacement of the net pockets as they become worn.

The side pockets for the table are formed in the same way as the corner pockets, save that the shape of the metal pressing required to follow the contour of the adjacent rail members is straight rather than curved.

With either the drop rail or net pocket arrangements noted above the extended fabric layer 125 runs into the arcuate cut out 135 and overlies the mouth of the funnel 200. If a net pocket arrangement is used for the table the extended fabric is desirably provided with a plurality of hooks engaging the netting of the pocket.

FIG. 8 illustrates a complete table made by assembling the various parts noted above in the manner described and shows it to have a playing surface formed by the layer 125, rails 180, cushions 184, pockets 194, and legs 160. Cue rests and other furniture have been ommitted from this view but it will be appreciated that such items are included in the table as sold.

It will be appreciated that various modifications to the arrangements disclosed above may be made to the arrangements described.

In one alternative arrangement (not shown) the foot plate 165 is replaced with a composite plate/castor arrangement which may be adjusted to bring either the plate or the castor into contact with the floor on which the table stands to allow the table to be rolled from one position to another if desired.

If desired the sections of the table top 120 may be hinged together as additional support therefor.

The table top may be formed of more or less sections than the number (three) shown and the abutting edges of the sections, when the table is assembled, may extend in any desired direction—the direction being selected in dependence upon the need to provide that the table is readily portable and storable for carriage Thus the pieces which together form the table top may have edges which abut (when the top is assembled) along a line running along the length of the table top or at an angle thereto.

The directions in which the "joins" of separate pieces of the table top extend may vary from table to table and within a single table if desired.

The lines of the joins between the different sections of the table top may be non-linear, that is to say shaped to follow meandering, wavey or zig-zag paths, when the table is assembled; if formed in this fashion the remote possibility of the lines affecting the path of movement of a ball running across the table top is minimised.

The single layer of plastics material 126 may be replaced by the number of separate, thinner layers and by varying the number of those layers it is possible to vary the movement characteristics of a ball crossing the playing surface—generally an increase in the number of such layers will add to the resistance to a balls travel across the playing surface. If this alternative is used then generally between four and twenty layers of relatively thin plastics material between the board and the sheeting forming the playing surface will lead to an arrangement mimicing the playing characteristics of a traditional table.

Other modifications which could be made are that the hooks described as being provided on the extended parts of the layer 125 could be replaced by any suitable fixing means (studs, clips etc.).

The full size Snooker table described has particular advantage in that the top of it may be folded upon itself for storage and/or carriage. The table top, however, need not necessarily be sectionalised in this way—particularly if the table is to be smaller than 'full size'. Again it will be appreciated that the particular construction of table base described may be varied if the size of the table is other than full size.

It will be appreciated that one or more of the various modifications to the arrangements disclosed and discussed above may be individually incorporated in ball games tables embodying my invention in order to provide a form of table which is capable of easy storage or carriage, e.g. in a van, which is weather resistant (and may therefore be used outdoors without fear of it being affected by inclement weather) and which has playing characteristics similar to those of traditionally made tables.

I claim:

1. A ball games table, comprising:

a table base;

a table top supported by and fixed to said table base, said table top having edges and comprising a plurality of flat separate sections of boarding;

means connected to said sections for enabling rigid interconnection of said sections of boarding with one another as the table is assembled;

a plurality of separate sheets of material covering said separate sections, said plurality of separate sheets including an uppermost sheet, each of said separate sheets covering said boarding and the uppermost sheet of said plurality of sheets acting to form a playing surface, each of said sheets of said plurality of sheets of material being affixed to said table top at said edges thereof, the uppermost sheet of said plurality of separate sheets of material being selected from the group consisting of canvas and tarpaulin and each other sheet of said plurality of separate sheets interposed between the uppermost sheet and the boarding being of plastics material; and a plurality of members interposed between said table base and said table top, each of said members having a height which is individually variable to allow said table top to be levelled.

2. A ball games table as claimed in claim 1, wherein said table base has leg members and wherein the lengths of said leg members may be adjusted such that the table top and said playing surface may be levelled.

3. A ball games table, comprising:

a table base in the form of a framework having leg members;

a table top demountably fixed to said base, said table top having edges and comprising flat boarding;

a plurality of separate and distinct sheets of material stretched across said flat boarding, said plurality of separate sheets having an uppermost sheet, each said separate sheet extending across and covering said boarding and the uppermost sheet of said plurality of sheets acting to form a playing surface;

wherein the uppermost sheet of said plurality of separate sheets of material acting to form a playing surface, is selected from the group consisting of canvas and tarpaulin and wherein each other sheet of said plurality of separate sheets interposed between the uppermost sheet and the boarding is of plastics material;

wherein the base is separable into component parts, and wherein the table top, when the table is assembled, is supported on the table base with interposition of a plurality of members the heights of which may be individually varied to allow the table top to be levelled.

4. A table as claimed in claim 3, wherein the lengths of the leg members forming part of the table base may be adjusted such that the table top and said playing surface may be levelled.

5. A table as claimed in claim 3, wherein the table top underlying the playing surface comprises a plurality of sections of flat boarding which sections, when the table is assembled, lie in a plane and are covered by said plurality of separate sheets of material and are interconnected by hinges.

6. A table as claimed in claim 3, wherein the table top underlying the playing surface comprises a plurality of sections of flat boarding which sections, when the table is assembled, lie in a plane and are covered by said plurality of separate sheets of material and wherein the join lines of different sections are non-linear.

* * * * *